US011328700B2

(12) United States Patent
Galuten

(10) Patent No.: US 11,328,700 B2
(45) Date of Patent: May 10, 2022

(54) DYNAMIC MUSIC MODIFICATION

(71) Applicant: Sony Interactive Entertainment LLC, San Mateo, CA (US)

(72) Inventor: Albhy Galuten, Santa Monica, CA (US)

(73) Assignee: Sony Interactive Entertainment LLC, San Mateo, CA (US)

( * ) Notice: Subject to any disclaimer, the term of this patent is extended or adjusted under 35 U.S.C. 154(b) by 121 days.

(21) Appl. No.: 16/838,775

(22) Filed: Apr. 2, 2020

(65) Prior Publication Data

US 2020/0312287 A1 Oct. 1, 2020

Related U.S. Application Data

(63) Continuation-in-part of application No. 16/677,303, filed on Nov. 7, 2019.

(60) Provisional application No. 62/768,045, filed on Nov. 15, 2018.

(51) Int. Cl.
*G10H 1/00* (2006.01)
*G10H 1/06* (2006.01)

(52) U.S. Cl.
CPC ..... *G10H 1/0025* (2013.01); *G10H 1/06* (2013.01); *G10H 2210/026* (2013.01); *G10H 2210/095* (2013.01); *G10H 2210/501* (2013.01); *G10H 2210/525* (2013.01); *G10H 2210/555* (2013.01); *G10H 2210/561* (2013.01); *G10H 2210/571* (2013.01); *G10H 2220/106* (2013.01); *G10H 2240/085* (2013.01)

(58) Field of Classification Search
CPC .. G10H 1/00; G10H 1/0025; G10H 2210/111; G10H 2210/105; G10H 2210/145; G10H 2210/031; G10H 2210/101
See application file for complete search history.

(56) References Cited

U.S. PATENT DOCUMENTS 5,451,709 A * 9/1995 Minamitaka ..... G10H 1/0025 84/609
6,124,543 A 9/2000 Aoki
9,583,084 B1 * 2/2017 Fagan ..... G10H 1/38
9,799,312 B1 * 10/2017 Cabral ..... G06N 5/04
(Continued)

FOREIGN PATENT DOCUMENTS

KR 20180005277 A 1/2018
WO 2007043679 A1 4/2007

OTHER PUBLICATIONS

International Search Report and Written Opinion dated Jan. 29, 2020 for International Patent Application No. PCT/US2019/060306.

(Continued)

*Primary Examiner* — Marlon T Fletcher
(74) *Attorney, Agent, or Firm* — JDI Patent; Joshua D. Isenberg; Robert Pullman

(57) ABSTRACT

A method for electronic music generation comprising electronically applying one or more functions that change one or more compositional elements of a musical input in a first tonality or other musical representation to generate a musical output in a second tonality or other musical representation and recording data corresponding to the musical output in a recording medium or rendering such musical Transformations to a reproductive medium such as an amplifier and speakers or headphones.

24 Claims, 12 Drawing Sheets

(56) References Cited

U.S. PATENT DOCUMENTS

| | | | | |
|---|---|---|---|---|
| 10,964,299 | B1 * | 3/2021 | Estes | G10H 1/0025 |
| 2003/0128825 | A1 | 7/2003 | Loudermilk | |
| 2003/0167907 | A1 * | 9/2003 | Annen | G10H 1/46 84/615 |
| 2007/0044639 | A1 | 3/2007 | Farbood et al. | |
| 2008/0141850 | A1 | 6/2008 | Cope | |
| 2009/0304207 | A1 | 12/2009 | Cooper | |
| 2010/0307320 | A1 | 12/2010 | Hoeberechts et al. | |
| 2012/0047447 | A1 | 2/2012 | Haq | |
| 2013/0025435 | A1 | 1/2013 | Rutledge et al. | |
| 2014/0076126 | A1 * | 3/2014 | Terry | G10H 1/34 84/609 |
| 2014/0180674 | A1 * | 6/2014 | Neuhauser | G10L 25/84 704/9 |
| 2016/0253915 | A1 | 9/2016 | Lee et al. | |
| 2017/0228745 | A1 | 8/2017 | Garcia et al. | |
| 2017/0365277 | A1 | 12/2017 | Park | |
| 2019/0237051 | A1 * | 8/2019 | Silverstein | G06N 7/005 |
| 2020/0005744 | A1 * | 1/2020 | Godunov | G10H 1/0025 |
| 2020/0074877 | A1 | 3/2020 | Marradi | |
| 2020/0105292 | A1 | 4/2020 | Large et al. | |
| 2020/0312287 | A1 * | 10/2020 | Galuten | G10H 1/06 |
| 2020/0380940 | A1 * | 12/2020 | Abdallah | G06N 7/005 |
| 2021/0043177 | A1 * | 2/2021 | Bar-Or | G10H 1/0008 |
| 2021/0201863 | A1 * | 7/2021 | Bosch Vicente | G10H 1/0025 |

OTHER PUBLICATIONS

Kim et al. "Music Emotion Recognition: A State of the Art Review"; 11th International Society for Music Information Retrieval conference; Publication [online]. 2010 [retrieved Jan. 13, 2020]. Retrieved from the Internet:; pp. 255-266.

U.S. Appl. No. 16/677,603 to Albhy Galuten filed Nov. 7, 2019.

International Search Report and Written Opinion dated Jun. 21, 2021 for International Patent Application No. PCT/US2021/025371.

Non-final Office Action dated Dec. 27, 2021 for U.S. Appl. No. 16/677,303.

Non-Final Office Action for U.S. Appl. No. 16/677,303, dated Dec. 27, 2021.

* cited by examiner

DYNAMIC MUSIC MODIFICATION

CLAIM OF PRIORITY

This application is a continuation-in-part of U.S. patent application Ser. No. 16/677,303 filed Nov. 7, 2019, the entire contents of which are incorporated herein by reference. U.S. patent application Ser. No. 16/677,303 claims the priority benefit of U.S. Provisional Patent Application No. 62/768,045, filed Nov. 11, 2018, the entire disclosures of which are incorporated herein by reference.

FIELD OF THE DISCLOSURE

The present disclosure relates to the fields of music composition, music orchestration and machine learning. Specifically, aspects of the present disclosure relate to automatic manipulation of compositional elements of a musical composition.

BACKGROUND OF THE DISCLOSURE

Currently, music is mostly created by some combination of a musician or musicians writing musical notes on paper or recording them and sometimes by several musicians collaborating on a piece of music over time as the creation evolves, sometimes in a studio where the composition process can take place over an indeterminate period.

In parallel Machine Learning and Artificial Intelligence have been making it possible to generate content based on training sets of existing content as labeled by human reviewers or musical convention.

SUMMARY OF THE DISCLOSURE

The present disclosure describes a mechanism for changing music, on the fly (dynamically) based on written or artificially generated motifs, which are then modified using real or virtual faders that change the music based on the characteristics of its musical components such as time signature, melodic structure, modality, harmonic structure, harmonic density, rhythmic density and timbral density.

Overview

Music is made of many parameters including but not limited to time signature, melodic structure, modality, harmonic structure, harmonic density, rhythmic density and timbral density. Generally, these parameters are not applied by music generation software and are instead simply may be considerations the composer has when generating a new musical composition. When music is composed, a composer often begins with one or more motifs, uses them, and changes them throughout the piece. According to aspects of the present disclosure, a set of virtual or physical faders and switches may be used to make those changes automatically based on the above parameters (melodic structure, modality, etc.) as time continues. The time could be linear with the faders and switches being used to create a composition. Alternatively, faders and switches could be used to generate the music dynamically based on emotional elements or elements that appear in a game, movie, or video as described in patent application Ser. No. 16/677,303 filed Nov. 7, 2019, the entire contents of which are incorporated herein by reference. The present disclosure describes a system of faders and switches that are associated with various musical parameters that can be controlled by a human operator.

BRIEF DESCRIPTION OF THE DRAWINGS

The teachings of the present invention can be readily understood by considering the following detailed description in conjunction with the accompanying drawings, in which.

DESCRIPTION OF THE SPECIFIC EMBODIMENTS

As used herein, the term musical input describes a musical motif such as a melody, harmony, rhythm or the like provided to the mixing console described below. Similarly, a musical output is a melody, harmony, rhythm or the like output by a mixing console after the musical input undergoes one or more of the operations described below. While some aspects of the disclosure may describe operation performed on a melody for simplicity, it should be understood that such operations may be performed on any type of musical input.

Figure 1:
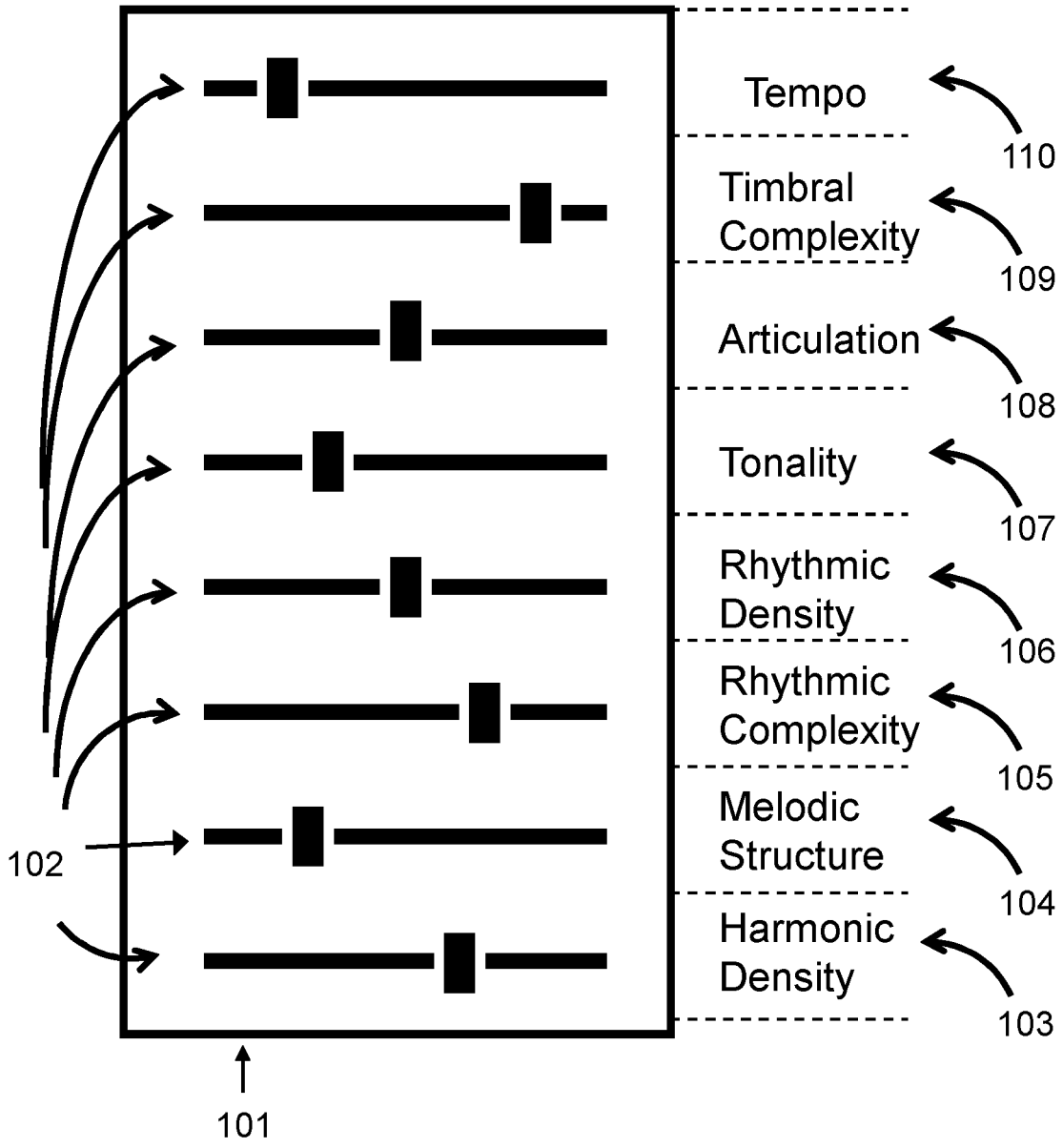
FIG. 1 depicts a schematic diagram of a physical or virtual mixing console that includes labeled faders for changing the compositional nature of a musical input according to aspects of the present disclosure.

As can be seen in FIG. 1, a control panel 101 may include a number of faders 102 which can be used to control, for example and without limitation, Dynamic Parameters: Harmonic Density 103, Melodic Structure 104, Rhythmic Complexity 105, Rhythmic Density 106, Tonality 107, Articulation 108, Timbral Complexity 109, and Tempo 110. The parameters are used to affect various motifs created by either a human composer or a machine-based AI composer. These motifs can be melodic, harmonic, timbral or rhythmic and various parameters can be combined based on human or machine input. For example, and without limitation, a human composer may begin with an input work and the machine could generate rhythms or vice versa with input for machine from the control panel changing the compositional nature of the input work.

The faders are used to vary compositional components along an axis. More faders may be used to vary other parameters of those components, as can switches. The assignment of the parameters to the faders and switches is not limited to a single preset and the composer can have broad control over their behavior. The composer may customize the behavior of each fader or switch individually using the dynamic parameters discussed herein as touchstones for slider behavior.

The first Variable Parameter is the selection of Scalar Elements. Even non-musicians are aware that major songs tend to be "happy" and minor songs tend to be "sad." However, the scale from which a melody is composed has a many more nuanced choices. Even on the happy/sad scale, changes in the scale of the composition may have a more nuanced effect on the overall feel of the song than just changing the mood from happy to sad or vice versa. Additionally, there are more scales than just minor and major scales and transposition of an input melody to these scales may shift the overall mood of a piece and change the overall compositional nature of the melody. As can be seen if FIG. 3, scales can be broken into different groupings with emotional components associated to the scalar properties. The most common in the West come from the Greek Modes 301, which go from brightest (Lydian) to darkest (Locrian). A fader can be configured to transform a musical input to the different Greek Modes from brightest to darkest so that as music is playing the scalar components can be changed dynamically using that fader. Here, "transform" means to change the pitches of the notes within a scale without raising or lowering the tonic or the whole scale. According to some aspects of the present disclosure the pitches and notes within the scale may be changed, e.g., by changing the key signature associated with those notes. For example, suppose a motif or melodic phrase uses notes of a C major scale. Assuming the order of the modes goes from brightest to darkest, each mode will change the notes used in that motif. Again, beginning with a C major motif, the notes can include C, D, E, F, G, A or B. The brightest setting on the fader, e.g., the top of the fader, would be for example Lydian, which would have F♯ s instead of F♮s. Thus, if a melody went G, F, E, it would now go G, F♯, E. As the fader is lowered, the notes currently playing would be flattened as the fader passed through the different modes. The first below C Major (or Ionian) would be Mixolydian, which has one flat, and the Bs would become B♭s. Each lowering of the fader would go one scale darker. Below Mixolydian is Dorian with B♭s and E♭s. Next down is Aeolian or Natural Minor with B♭s, E♭s and A♭s. Below that is Phrygian with B♭s, E♭s, A♭s and D♭s and below that Locrian with B♭s, E♭s, A♭s, D♭s and G♭s. Thus, by using this fader one can modify the tonality of the melody. Now suppose for example a 4-bar phrase made up of the notes of a C major scale. The notes could be modified by slowly lowering the fader through 8, 16, or 32 bars so that the melody got darker and darker as it progressed. For example, and without limitation taking the melody and moving a fader to a Dorian setting, a note that would have been an E before would now be an E♭. Since rhythm is irrelevant to this portion of the disclosure, melodic names are used. For example, suppose a musical input begins in the Ionian mode in the key of C with a motif containing, in order, E F G C B D A G C. The pitches of these notes would change based on the position of the fader. For each fader position from top to bottom the modified notes would be: E F♯ G C B D A G C; E F G C B D A G C; E F G C B♭ D A G C; E♭ F G C B♭ D A G C; E♭ F G C B♭ D A♭ G C; E♭ F G C B♭ D♭ A♭ G C; E♭ F G♭ C B♭ D♭ A♭ G C.

The faders and/or switches may be coupled to a computer system or even a set of mechanical switches operated by humans and together or individually, the devices may be configured to manipulate the notes of a musical input based on the settings of the faders and switches. For example, and without limitation, a music composer might create a melodic phrase and have it encoded as data (e.g. using MIDI or MusicXML or voltages or any other naming or representational convention), and play that representation in real time on, for example, a digital keyboard or have recorded it previously. That representation then serves as the input to the faders and/or switches and a computer or other mechanism uses the algorithm described in this disclosure to Transform the notes, which are then rendered by an instrument module. One could use any instrument module from Analog Synthesizers to Frequency Modulation Synthesizers to Sampling Synthesizers to Physical Modeling Synthesizers to mechanical devices that make analog sounds like a piano roll or a Yamaha Disklavier. The computer may transform the representations of musical notes at the input to create by such transformation an output that is different from the input using the switches and faders as herein described. Alternatively, the faders and/or switches may be coupled to a computer system and together or individually, the devices may be configured to perform spectral analysis on an audio input to decompose the musical input's components into underlying tones, harmonies and timing and identify individual components that comprise the input. The devices may further be configured to manipulate the frequencies of the underlying spectral tones of the musical input to change the keys of the individual notes of the input. The devices may then reconstruct the decomposed musical elements and reconfigure as described here to generate a musical output that is different based on the positioning of the sliders and switches to effectuate the desired compositional changes. Alternatively, a Neural Network (NN) component may be trained with machine learning to generate a musical output in various different modes as discussed above based on the slider settings. The slider settings may adjust one or more inputs (controls) to the NN to determine the melodic mode of the output composition.

Figure 2A:
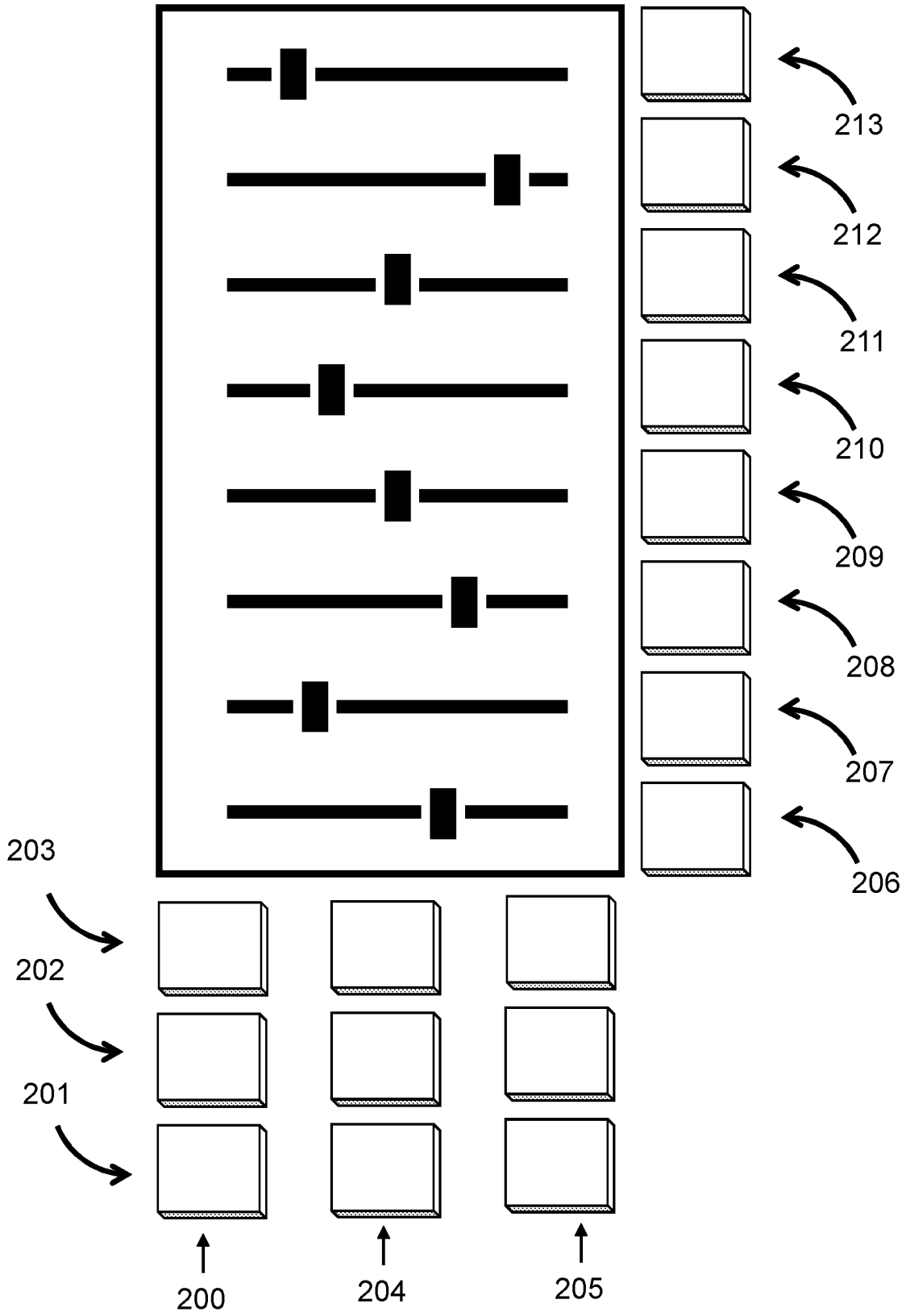
FIG. 2A depicts a schematic diagram of a physical or virtual mixing console with switches or buttons for compositional nature of a musical input according to aspects of the present disclosure.
Figure 2B:
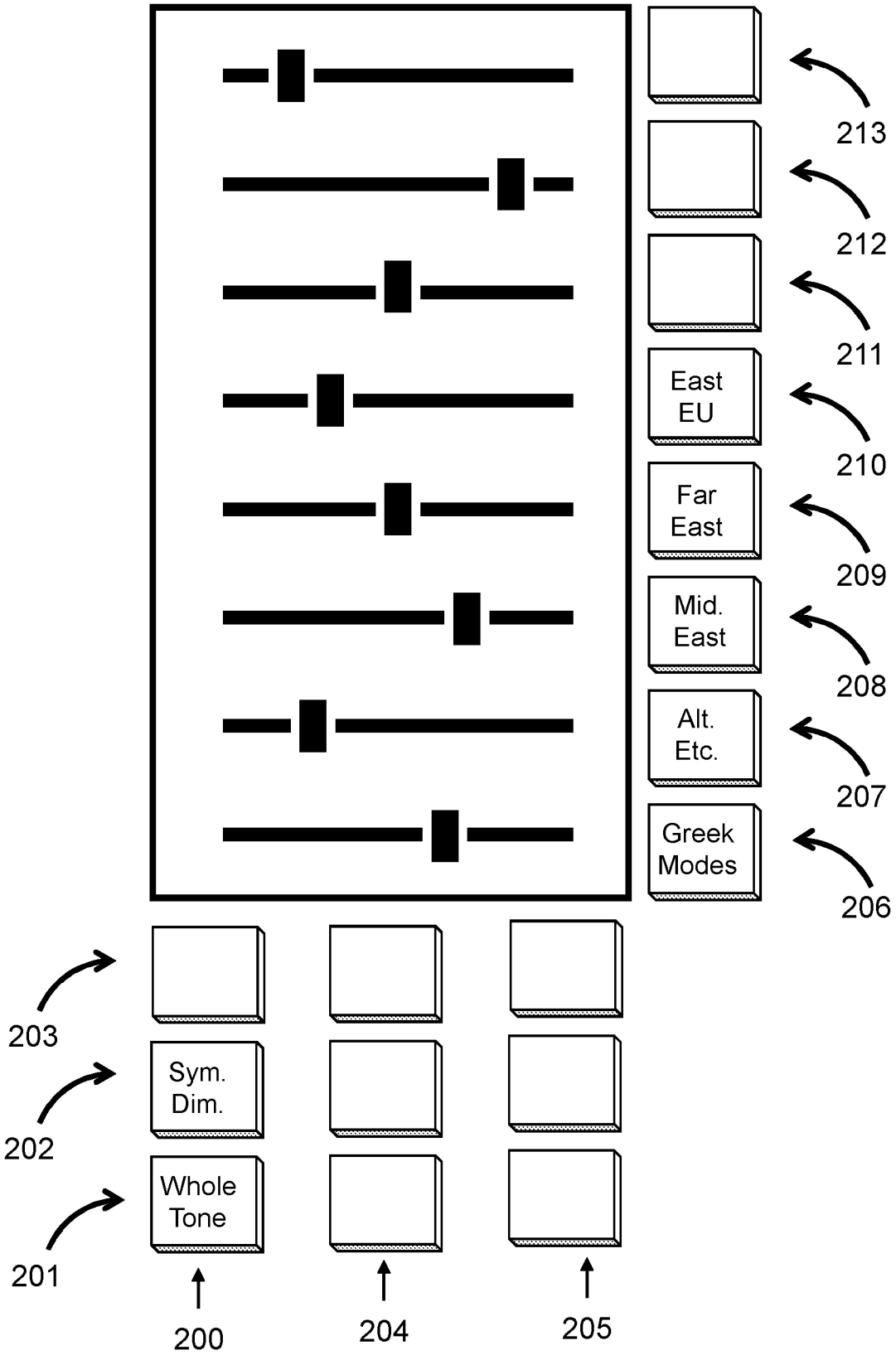
FIG. 2B depicts a schematic diagram of a physical or virtual mixing console with switches or buttons with labels for compositional nature of a musical input according to aspects of the present disclosure.
Figure 3:
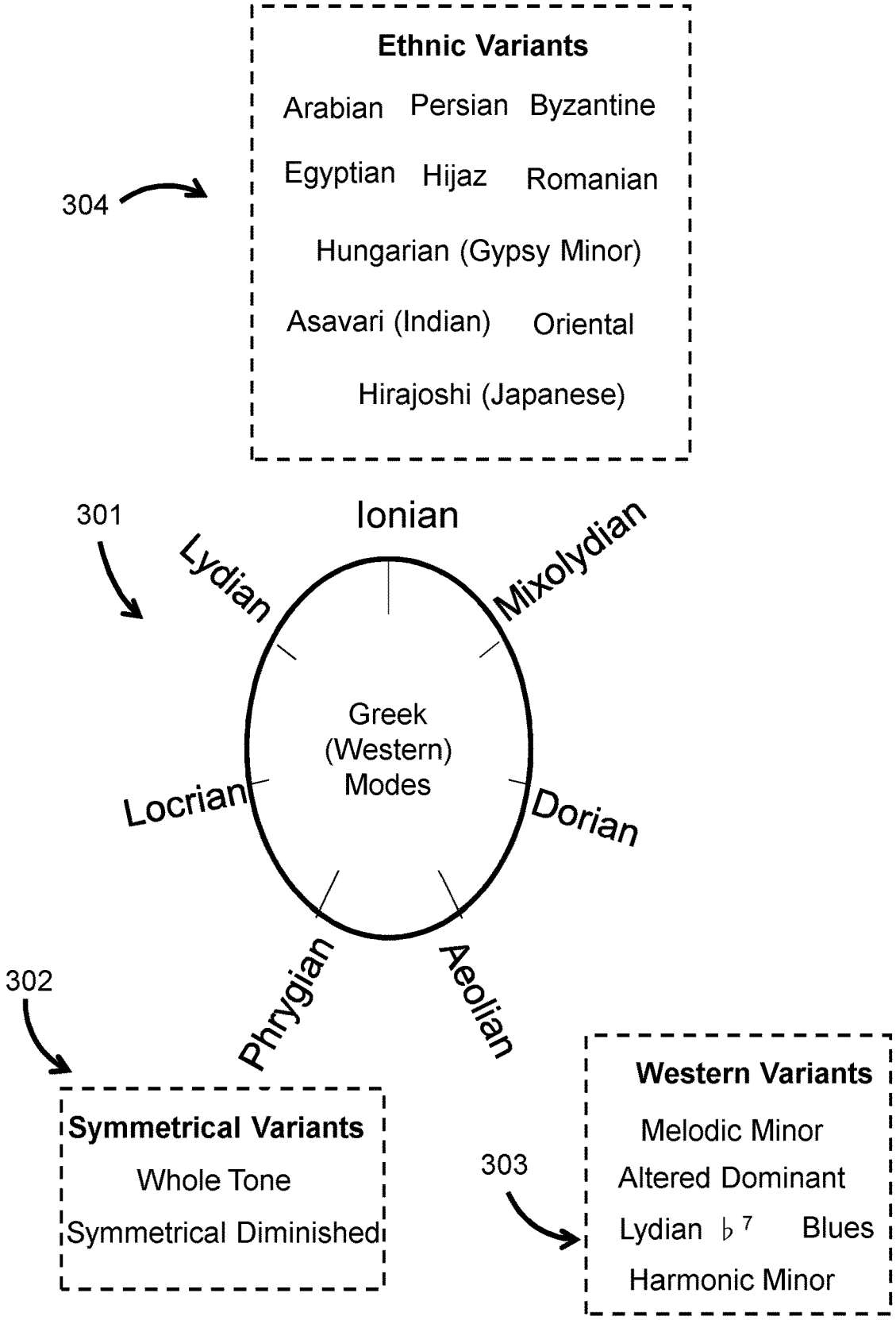
FIG. 3 is a diagram showing various Scalar Elements used in music composition and/or performance to be applied to a musical input via sliders and/or buttons according to aspects of the present disclosure.

Looking at FIG. 3, there are other scales. These are a bit less straightforward than the Greek modes in terms of emotional correspondence and there is no mapping of these other scales to one fader. First, the Symmetrical Variants 302 represent a continuum of sorts but are actually binary in nature so they may best be applied to two switches or a three-position switch. Because a single melody cannot be in multiple symmetrical variant modes at once, turning on one fader or switch must turn off another fader or switch. Looking at FIG. 2B, functions can be assigned to some of the buttons and faders. Suppose the first fader above switch 206 is used for the 7 Greek modes as described above from Lydian to Locrian. The switch below the fader 206 determines whether the fader is active on the melody or not with the "on" state being active. Suppose the two Symmetrical Variants 302 are assigned to two switches 201 and 202. Now there are three Exclusionary (Exclusionary meaning only one can be active at a time) scales or sets of scales: the 7 Greek Modes on a fader, Whole Tone, which would be C D E F♯ (G♭) G♯ (A♭) A♯ (B♭) on switch 201 and Symmetrical Diminished which would be C D♭ E♭ E F♯ G A B♭ on Switch 202. Note that both the Whole Tone (6-note scale) and Symmetrical Diminished (8-note scale) have a different number of notes than the Greek Modes or traditional western scales. Various mechanisms can be used to map the choices where the scales contain mismatched numbers of notes. For example, and without limitation: sharps for ascending lines and flats for descending or the note choice closest to or furthest from the previous tonality. This logic is variable and programmable either by humans or by AI as it looks at the melodies upon which it was trained. These same mechanisms can be used for any of the other scales that have less than or more than 7 notes. Now, using the same logic as was used for modifying the Greek modes in the example melody (E F G C B D A G C), the melody can be modified by switching the notes of the melody to E F♯ G♯ C B♭ D A♯ G♯ C when the whole tone button is on and E F♯ G C B♭ D♭ A G C when the Symmetrical Diminished button is on. Furthermore, according to aspects of the present disclosure, the scale of a musical input may be varied during playback of the output composition buttons can be turned on and off and faders moved at any time during the melodic sequence changing the output composition on the fly.

It is noted that labels are somewhat arbitrary. Society agrees on a specific label Blue for the color blue but that is only by convention (or language). However, without labels, it would be difficult to remember and certainly harder to describe colors to others. Even emotions such as happy to sad on the modal continuum are subjective. Musicians (as evidenced by labeling on keyboard synthesizers) are very good at adapting to labels. A musician might label the Whole Tone scale as Ethereal (most would probably agree) and the Symmetrical Diminished as Spooky (more subjective). It really does not matter what labels are chosen and in fact individual composers can choose or change the labels as they see fit. What is important is that there is a mechanism for modifying compositions based on the changes proposed in this disclosure. First the Western Variants 303, Lydian ♭7, Altered Dominant and Melodic Minor are all different modes of the same scale (as the Greek modes are different modes of the major scale) and so these would naturally fit on a fader. The Blues Scale and the Harmonic Minor Scale are both well known to composers by those names and should probably go on switches under those names.

Looking at labeling for functions of a Fader Switch Matrix, such as that depicted in FIG. 2B, the faders may be assigned as follows: Fader and associated button 206 is the Greek Modes (the button being on/off). Fader and associated button 207 are the Altered Dominant/Lydian ♭7/Melodic Minor continuum. Switch 201 is Whole Tone and Switch 202 is Symmetrical Diminished. This leaves the Ethnic Variants. These can be grouped together on faders, say Middle Eastern ones on Fader/Switch 208, Far Eastern ones on Fader/Switch 209 and Eastern European ones on Fader/Switch 210 or they can be individually routed to switches. Composers can try different routings and use which ever seems most appropriate to their individual style or to the piece at hand.

Figure 4:
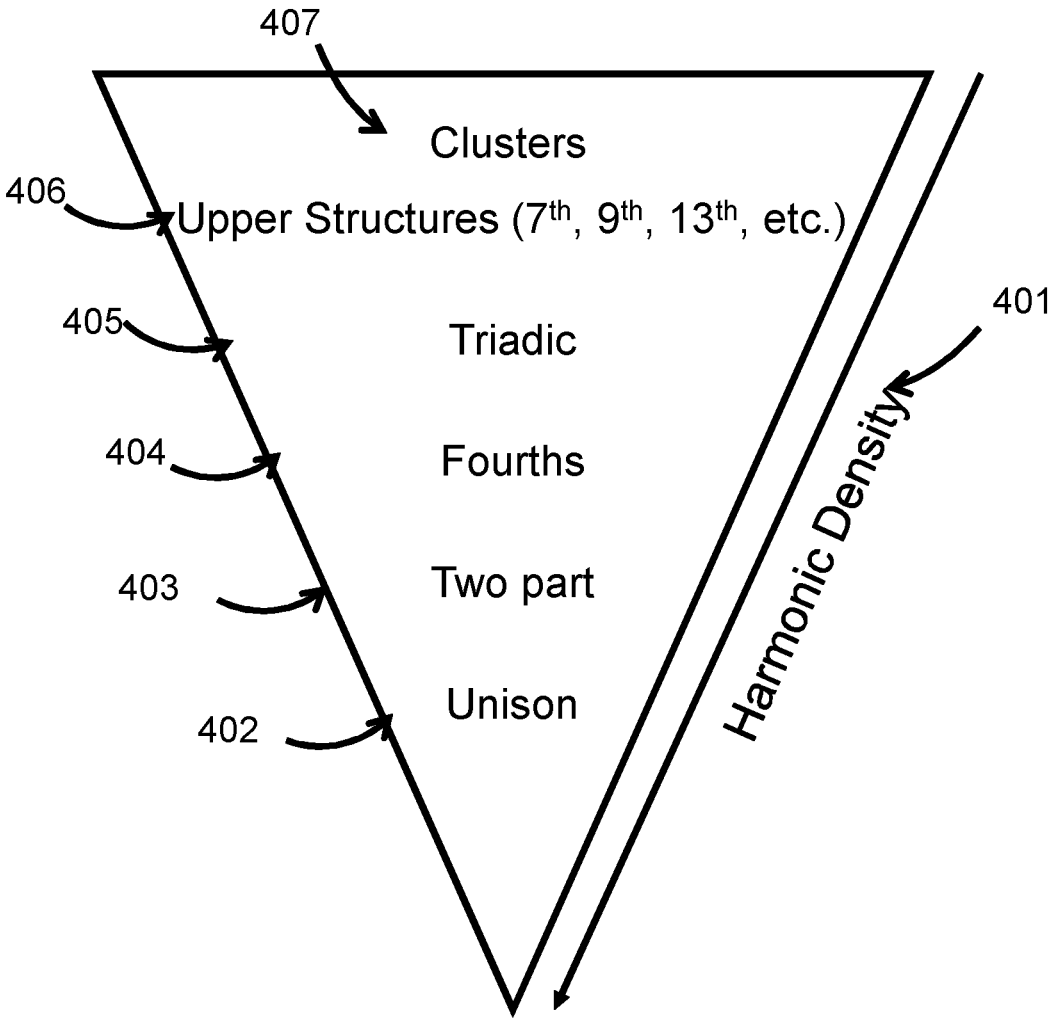
FIG. 4 is a diagram depicting variation in Harmonic Density as used in music composition and/or performance to be applied to a musical input via sliders and/or buttons according to aspects of the present disclosure.

Aspects of the present disclosure also address other elements of composition and orchestration or arranging. By way of example, FIG. 4 addresses Harmonic Density. Harmonic Density is naturally a continuum from Unison to Two part to Triadic to Fourths to Voicings with Upper Structures (7th, 9th, 13th, etc., ♮ or ♭) to Clusters. Typically, a composer (or an AI) would create a harmonic structure that is associated with a melodic phrase. Some compositions have no real melody and only, really, a harmonic structure. Assuming, to start, that there is a basic harmonic structure associated with the melody, that harmony will naturally change as the melody changes. If the melody were changed from major to minor, the appropriate chords would naturally follow. FIG. 4 addresses a step beyond that. It is assumed, to start, that a harmony follows the tonality of the melody (though exceptions will be addressed in the section that includes dissonance).

The Harmonic Density 401 may be mapped to one or more faders or to switches. In the broadest use for example and without limitation, the bottom of the fader would be unison. That is just the melody 402 and as you move the fader up the harmonization would go through Two Part Voicing 403, Structures in Fourths 404, Triadic Structures 405 in open voicing, and then in closed voicing, then adding upper structure harmonies like 9ths 11ths and 13ths 406. Finally, the most harmonically dense structures are clusters 407.

Alternatively, each of the Harmonic Density settings may be mapped to switches; again, "exclusive" meaning only one can be active at a time. However, you can have a Harmonic Density switch active while you have a Melodic Tonality switch active at the same time. These are Non-Exclusive—that is they can be used in combination with other parameters.

Figure 5:
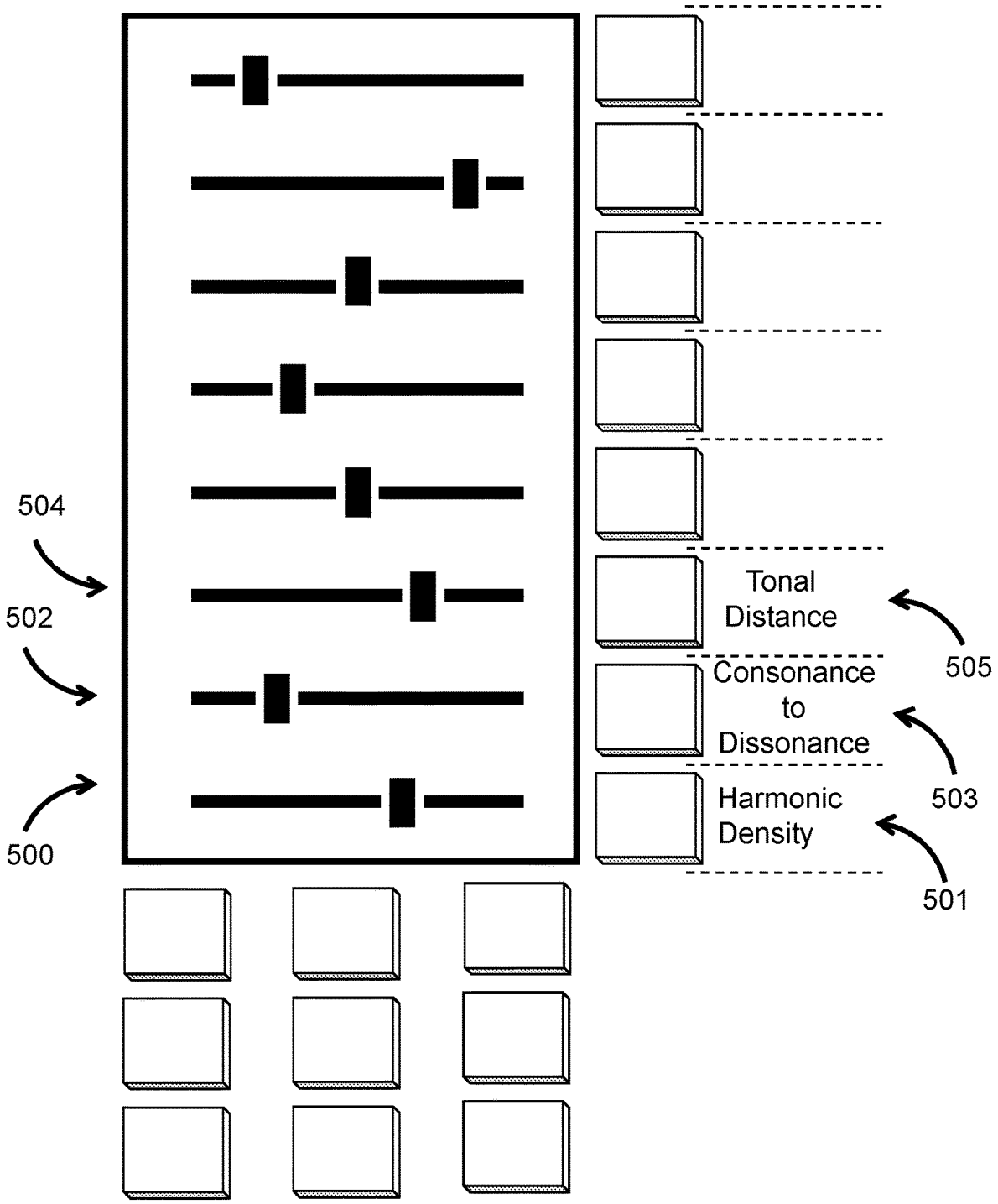
FIG. 5 is a diagram depicting multiple sliders and/or buttons for creation variation in Melodic Structure as used in music composition and/or performance as applied to a musical input according to aspects of the present disclosure.

Another variant on Harmonic Density is Harmonic Substitution. Harmonic Substitution can be spread across two axes: from Consonance to Dissonance and the axis of Tonal Distance. Tonal Distance, as used herein and as understood by those skilled in the musical arts, means the distance from the notes within the key of the melody. Since Harmonic Density and Harmonic Substitution from Consonance to Dissonance and Tonal Distance are on a continuum, they would all be mapped to faders. As seen in FIG. 5 where the first Fader 500 is mapped to the function Harmonic Density 501, the second fader 502 is mapped to the continuous function Consonance to Dissonance 503 and the third fader 504 is mapped to the Tonal Distance 505. There is a well-known mapping of intervals from Consonant to Dissonant (in order: Octave, Fifth, Fourth, Major Sixth, Major Third, Minor Third, Minor Sixth, Major Second, Minor Seventh, Minor Second, Major Seventh, Tritone, Minor Ninth) and these can be used to create harmonic substitutions which would be effectuated by moving the fader 502 up and down. Dissonances would be cumulative so that a chord with two minor seconds would be more dissonant than one with only one minor second along a scale of closeness to the tonality of the chord. The third domain of Harmonic Density has to do with reharmonization but in this context is better referred to as Tonal Distance. This follows a trajectory of further and further removed reharmonization. The most "expected" are tonalities within the original tonality. For example and without limitation, substituting, in the key of C, a Dm 7 ♭5 for an Fm, is still within the scale and the tonality but replacing an Fm with a B♭7 is slightly richer because it uses a note (B♭) that is neither in the key or in the original chord. There is a large corpus of standardized substitutions and these can be rated based on how far they diverge from the tonality of the original. The range could be set even further to completely dissonant and even atonal substitutions depending on the tonal range programmed into the fader. Thus, as shown in FIG. 5, there are, as one example, three faders and switches associated with Harmonic Structures. 1) Harmonic Density—the chord structure from Unison to Clusters, 2) Consonance to Dissonance—the degree of dissonance based on the cumulative degree of dissonance of the individual intervals and 3) Tonal distance—the degree of distance from the original tonality. The faders and/or switches along with a computer system may be configured to recognize notes that are input into the system using music encoded data (e.g., MIDI, MusicXML etc. as above) and identify harmonic structures from the note data or spectral analysis of musical input, the devices may alter and/or add harmonic structures based on the faders and/or switches settings as discussed above to generate an output composition. Alternatively, a NN may be trained to identify harmonic structures from the notes or a transformed musical input. Additionally, NNs may be trained to apply harmonic structures to a musical input based on the fader and/or switches settings.

Figure 6:
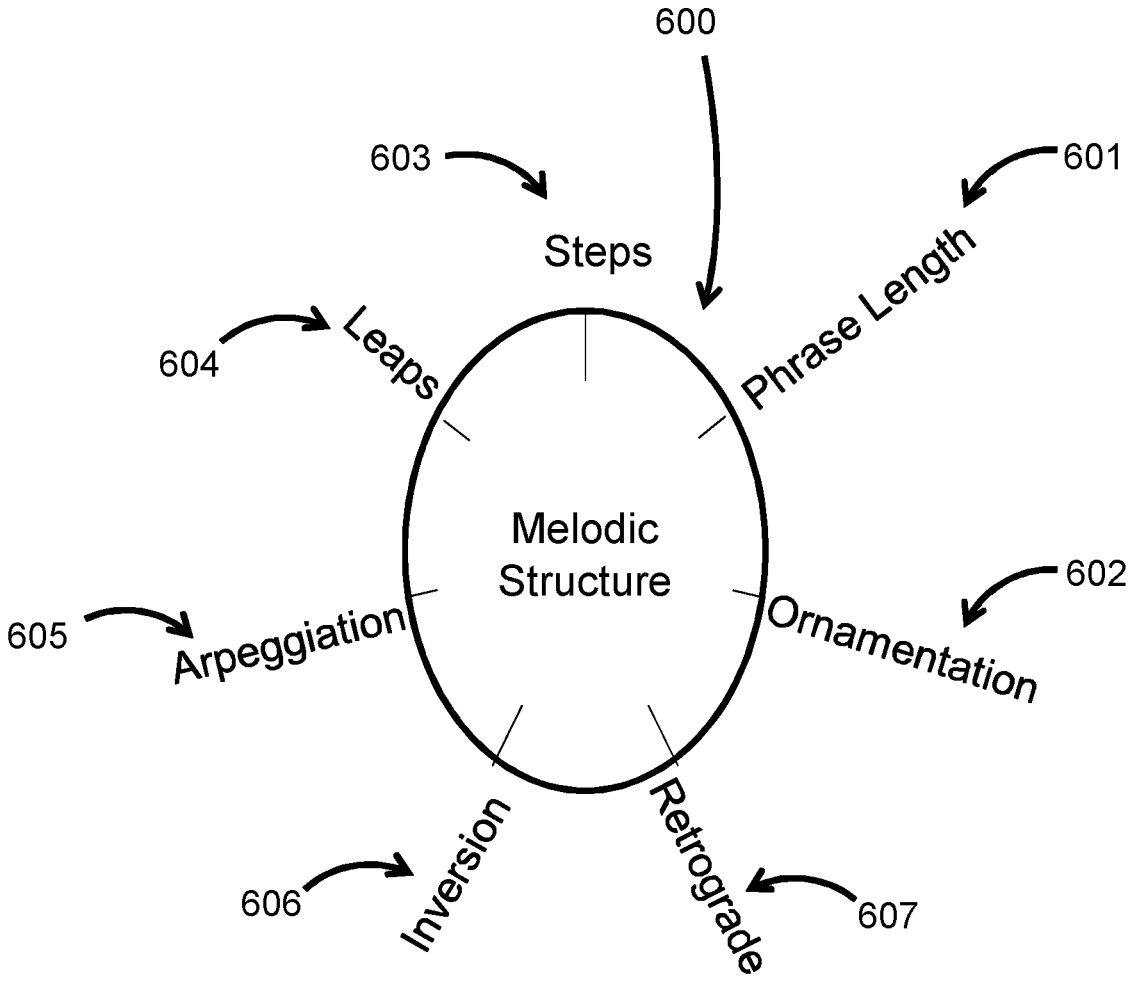
FIG. 6 is a diagram showing the variations of Articulation, Rhythmic Density, Rhythmic Complexity and Timbral Complexity that may be applied independently to a musical input according to aspects of the present disclosure.
Figure 7:
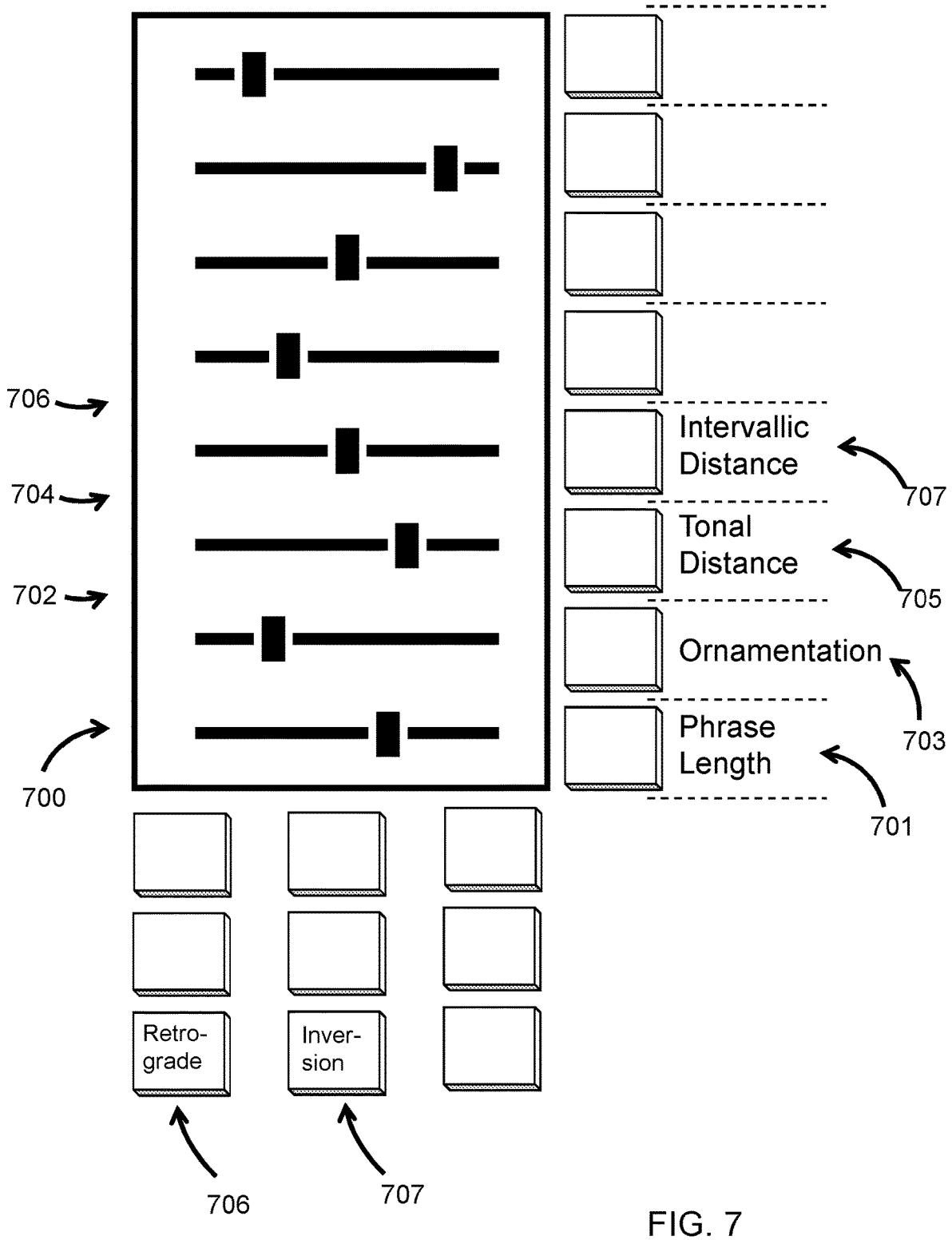
FIG. 7 a schematic diagram of a physical or virtual mixing console, which includes labeled faders for changing the melodic structure of a musical input according to aspects of the present disclosure.

The next element for varying a musical input is called Melodic Structure. The elements of Melodic structure are Non-exclusionary and may be varied independently. As seen in FIG. 6, Melodic Structure 600 includes elements such as Phrase length 601, Ornamentation 602, Retrograde 607, Inversion 606, Arpeggiation 605, leaps 604, and steps 603. There is a large corpus of melodic behavior around these melodic techniques. For example, phrase length can be varied based on changing the durations of the individual notes or based on exposition. Changing the durations of individual notes is linear and can logically be mapped directly to a fader. However, in the case of exposition, it would be best to train a Neural Network on examples of exposition from the cannon of notated music. Similar analysis as used above for mapping elements to switches and faders can be used here. Looking at FIG. 7, Phrase Length is mapped to Fader Switch Pair 700/701 and Amount of Ornamentation is mapped to Fader Switch Pair 702/703. Common ornamentation choices are Trill, Mordent, Turn, Appoggiatura, Acciaccatura, Glissando and Slide. Switches may be allocated to each possible ornamentation or to only the one(s) that are desired in a particular environment. Then the switch corresponding to a chosen ornamentation could be turned on when the ornamentation was wanted. A useful additional approach may be to assign an ornamentation such as a trill, to a fader where the fader controls the frequency of trills in the piece or alternatively the fader controls the duration of each trill. In some embodiments two faders may be used, one for duration and one for frequency.

Retrograde and Inversion are mathematically based and can be defined as a function taking into account the shape and the key of the input. Since the techniques or Retrograde and Inversion are both binary functions, they are assigned to buttons 706 and 707. Note that unlike the melodic Scalar elements in FIG. 2B, these are Non-exclusionary. Therefore, the phrase length can be varied at the same time as changing the amount of ornamentation and at the same time, you can have the melody Inverted and/or played in Retrograde.

Figure 8:
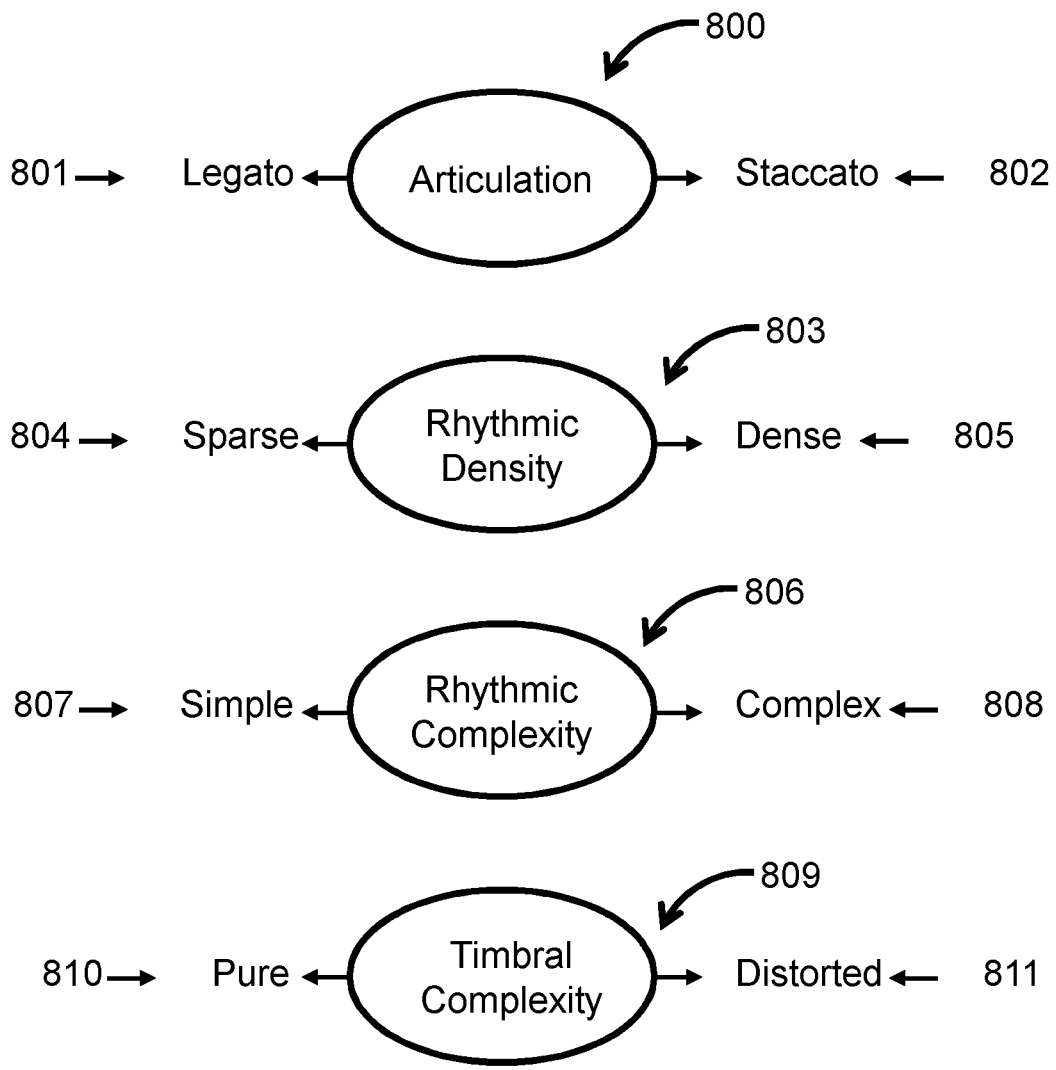
FIG. 8 is a diagram depicting the continuous nature of the various components of melodic, harmonic or rhythmic structure or timbral complexity as applied to a musical input according to aspects of the present disclosure.

There are some other Areas of variability that can be controlled by faders as they span a continuum of values. As shown in FIG. 8, Articulation 800 goes from Legato 801 to Staccato 802. The duration of the notes along the continuum is a simple linear function.

Rhythmic Density 803 is also variable that has a mappable range from Sparse 804—whole notes or longer to Dense 805—$32^{nd}$ or shorter. Rhythmic Density can be linear but would likely have unanticipated consequences. Using Machine Learning to contextualize Rhythmic density would likely yield more musical results. Rhythmic Complexity 806 is a bit more nuanced but rhythms across the beat lines are more complex than those on the beat lines and divisions like triplets, quintuplets and septuplets are even more complex. Generally, Rhythmic complexity goes from Simple 807 to Complex 808. Any mechanism from a simple switching algorithm to a complex NN may be used to change the rhythmic density of a musical input. In some implementations, a NN may be trained to recognize the Rhythm of the musical input and alter the rhythm of the input work to apply different note divisions to the musical input. For example, and without limitation, the NN may be trained to change whole notes to two half notes, half notes to two quarter notes, quarter notes to two eighth notes etc. The NN may also combine notes together to generate a faster beat for example two different half notes may become two different quarter notes. A NN trained on popular music from any era would naturally generate musical choices that could be fine-tuned using the faders.

The last continuum in this section is related to Timbre or Timbral Complexity 809. In traditional music flutes are close to a sine wave and are considered not complex timbrally while an oboe is more timbrally complex. Guitars have used varying degrees of distortion for years with traditional jazz guitars being very clean and Death Metal being very distorted. This continuum goes from Pure 810 to Distorted 811.

One last continuum is Tempo self-explanatory in this context—push the fader up and the song goes faster; pull it down and it goes slower.

Figure 9:
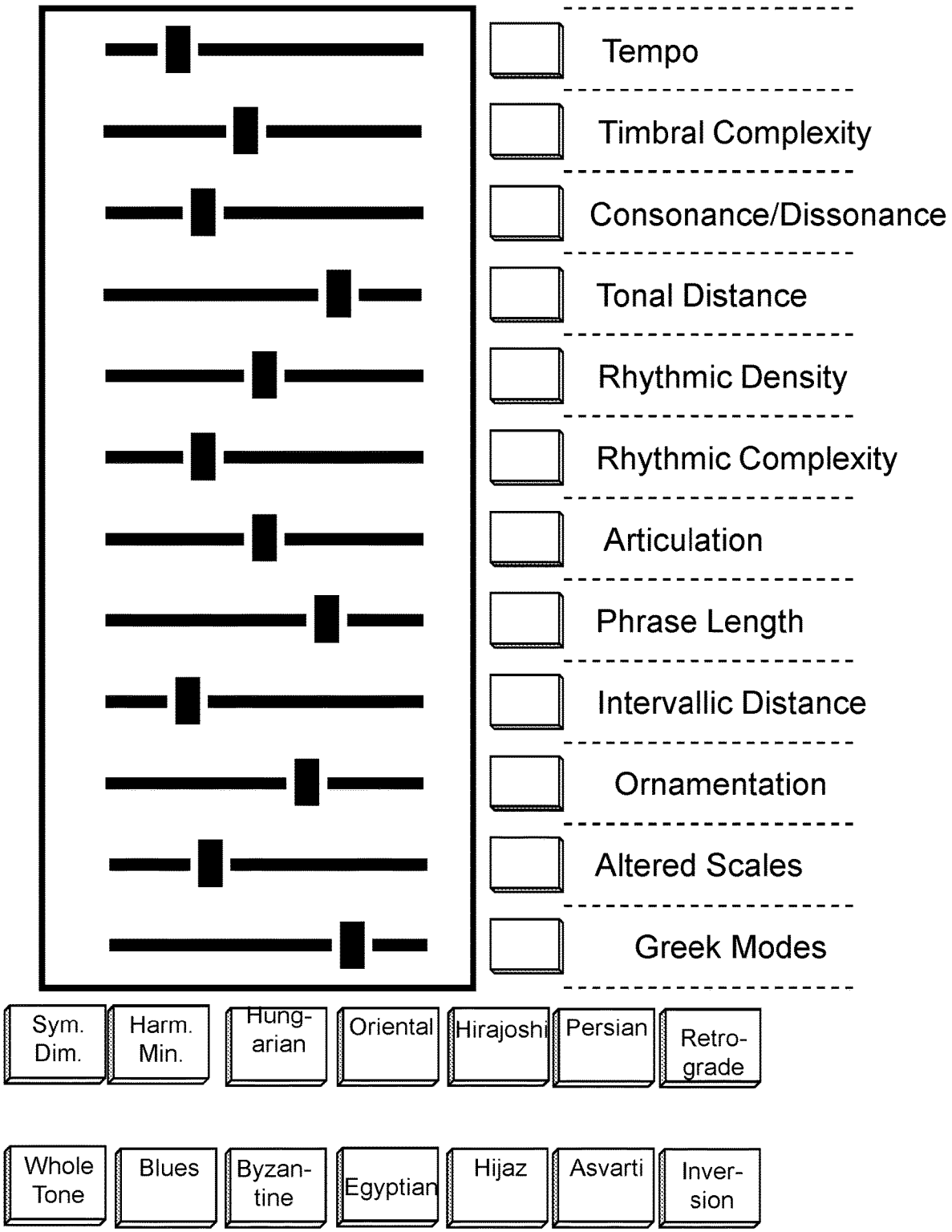
FIG. 9 depicts a fully labeled schematic diagram of a physical or virtual mixing console, which includes labeled faders for changing the compositional nature of a musical input according to aspects of the present disclosure.

FIG. 9 shows how all the various Switches and Faders might be laid out including most of the discussed parameters. Note that some are Exclusionary, specifically: Greek Modes (Ionian: 1, 2, 3, 4, 5, 6, 7, Dorian: 1, 2, ♭3, 4, 5, 6, ♭7, Phrygian: 1, ♭2, ♭3, 4, 5, ♭6, ♭7, Lydian: 1, 2, 3, ♯4, 5, 6, 7, Mixolydian: 1, 2, 3, 4, 5, 6, ♭7, Aeolian: 1, 2, ♭3, 4, 5, ♭6, ♭7, Locrian: 1, ♭2, ♭3, 4, ♭5, ♭6, ♭7), Altered Scales (Melodic Minor 1, 2, ♭3, 4, 5, 6, 7, Altered Dominant 1, ♭2, ♭3, ♭4, ♭5, ♭6, ♭7, Lydian $♭^7$ or Romanian 1, 2, 3, ♯4, 5, 6, ♭7), Harmonic Minor (1, 2, ♭3, 4, 5, ♭6, 7), Symmetrical Whole Tone: (1, 2, 3, ♯4, ♯5, ♯6), Symmetrical Diminished (1, ♭2, ♭3, 3, ♯4, 5, 6, ♭7), Blues (1, ♭3, 4, ♯4, 5, ♭7), Arabian, Byzantine or Double Harmonic (1, ♭2, 3, 4, 5, ♭6, 7), Persian (1, ♭2, 3, 4, ♭5, ♭6, 7), Egyptian (1, 2, 4, 5, ♭7), Hijaz or Phrygian Dominant (1, ♭2, 3, 4, 5, ♭6, ♭7), Hungarian or Gypsy Minor (1, 2, ♭3, ♯4, 5, ♭6, 7), Asavari or Indian (1, ♭2, 4, 5, ♭6), Oriental (1, ♭2, 3, 4, ♭5, 6, ♭7) and Hirajoshi or Japanese (1, 3, ♯4, 5, 7). The other faders are Non-exclusionary (Ornamentation, Intervallic Distance, Phrase Length, Articulation, Rhythmic Complexity, Rhythmic Density, Tonal Distance, Consonance/Dissonance, Timbral Complexity and Tempo.

Figure 10:
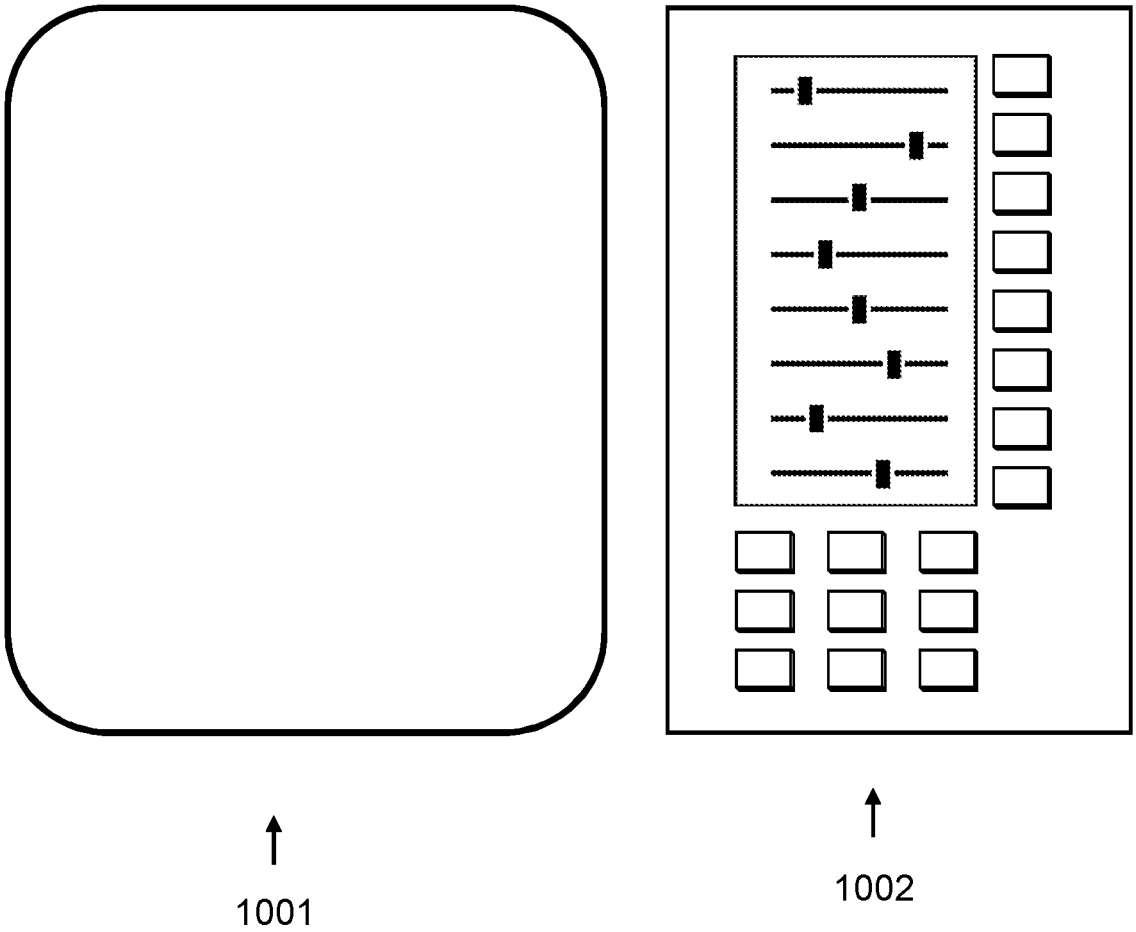
FIG. 10 is a schematic diagram showing a physical or virtual mixing console, which includes labeled faders and a composition monitor for changing the compositional nature of a musical input according to aspects of the present disclosure.

Some other features of the system, while not unique on their own are unique within the context of a system like this one. Loop Length is adjustable and can be changed based on time, number of bars, etc. As shown, in FIG. 10, whenever a fader is active or is touched, a video display 1001 can show the parameters affected by that fader. The video display can also show the state of the various buttons 1002 though they may also have their state visible based on the buttons being lit. Fader and switch actions can be recorded and played back and, as in most moving fader systems, when a fader is touched, it is controlled by the hand touching it and when it is no longer touched, it goes back to the recorded behavior.

Also, as described in the referenced previous application, parameters fader and switch positions) can be controlled by events and actions in games and this can be done using emotional vectors and or Artificial Intelligence.

Matrixing it all Together

Figure 11:
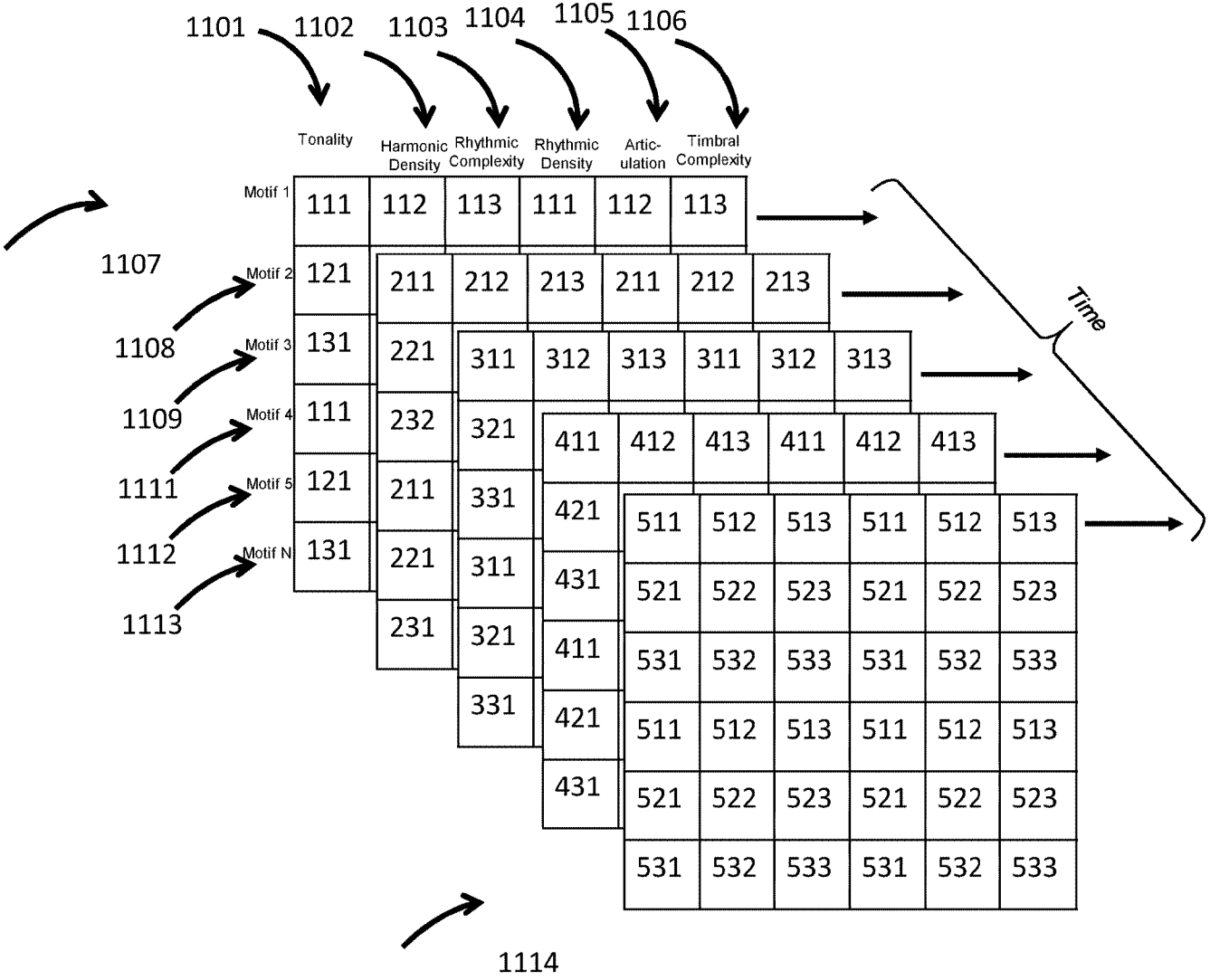
FIG. 11 is a depiction of a 3-dimensional matrix including the domains of multiple motives, musical elements to be varied and the time domain according to aspects of the present disclosure.

Settings of the faders and/or switches may be saved and used later or applied to other uses. The settings of the faders and/or switches may be saved in a data structure such as a table or three-dimensional matrices as shown in FIG. 11. As shown, one axes of the matrices may be considered the different parameters of the sliders for example and without limitation, Tonality 1101, Harmonic Density 1102, Rhythmic Complexity 1103, Rhythmic Density 1104, Articulation 1105, Timbral complexity 1106 etc. A second axis may contain that different motifs, harmonies, rhythms etc. that make up the composition. As shown the axes includes motif 1 1107, motif 2 1108, motif 3 1109, motif 4 1111, motif 5 1112, there may be unlimited motifs as denoted by motif N 1113. The numbers within each box of the matrices represent exemplar numerical settings for the fader sliders or switches. The Matrices represent time on a third axis as shown. Each passing time unit may generate another matrix 1114 filled with fader and/or switch settings. The time unit may be seconds, milliseconds, microseconds or the like, sufficient to capture changes in the slider settings during creation of the musical composition.

These matrices may be saved for each musical composition generated to create further data for compositional analysis. The matrices may be provided to one or more neural networks with a machine learning algorithm along with other data such as emotional vectors, style data, context etc. The NN with machine learning algorithm may learn associations with slider settings that may be applicable to other musical compositions in a corpus of labeled musical compositions. Additionally, with sufficient training the NN with machine learning algorithm may eventually be able to assign slider settings for different moods, musical styles etc. based on the training data.

The invention claimed is:

1. A method for electronic music generation comprising: electronically applying one or more functions that change a compositional nature of a musical input in a first tonality to generate a musical output in a second tonality, wherein applying the one or more functions includes changing the harmonic density of the musical input to generate variations in a harmony of the musical output, including changing a consonance or dissonance of the harmony of the musical output; and recording data corresponding to the output melody in a recording medium.

2. The method of claim 1, wherein changing the harmonic density includes changing a tonal distance of the harmony.

3. The method of claim 1, where generating an output melody in a second tonality includes changing the musical input from a first scale to a second scale wherein the second scale has a different number notes within the scale.

4. The method of claim 3, wherein generating the output melody in a second tonality includes adding sharp notes for ascending lines or flat notes for descending lines of the melody to change the musical input musical from a first scale to a second scale.

5. The method of claim 3, wherein generating the output melody in a second tonality includes choosing notes in the second scale closest to or furthest in tonality from the notes of the musical input to change the musical input to the second scale.

6. The method of claim 3, wherein changing the musical input from a first tonality to a second tonality includes changing between Greek modes or changing from a Greek mode to a non-Greek Scale.

7. The method of claim 1, wherein applying the one or more functions that change the compositional nature of the musical input includes changing a melodic structure of the musical input.

8. The method of claim 7 wherein changing the melodic structure of the musical input includes changing a phrase length of the musical input.

9. The method of claim 7 wherein changing the melodic structure of the musical input includes changing an ornamentation of the musical input.

10. The method of claim 7 wherein changing the melodic structure of the musical input includes changing the musical input by means of retrograde or changing the musical input by means of inversion.

11. The method of claim 1 wherein applying the one or more functions that change the compositional nature of the musical input includes changing a rhythmic density or rhythmic complexity of the musical input.

12. A system for electronic music generation comprising:

a processor;

memory coupled to the processor;

non-transitory instructions in the memory that when executed by the processor cause the processor to carry out the method for music generation comprising:

electronically applying one or more functions that change a compositional nature of a musical input in a first tonality to generate an output melody in a second tonality, wherein applying the one or more functions includes changing the harmonic density of the musical input to generate variations in a harmony of the musical output, including changing a consonance or dissonance of the harmony of the musical output; and recording data corresponding to the output melody in a recording medium.

13. The system of claim 12 wherein changing the harmonic density includes changing a tonal distance of the harmony.

14. The system of claim 12 where generating an output melody in a second tonality includes changing the musical input from a first scale to a second scale wherein the second scale has a different number of notes within the scale than the first scale.

15. The system of claim 14 wherein generating the output melody in a second tonality includes adding sharp notes for ascending lines or flat notes for descending lines of the melody to change the musical input from a first scale to a second scale having a different number of notes within the scale than the first scale.

16. The system of claim 14 wherein generating the output melody in a second scale includes choosing notes in the second scale closest to or furthest in tonality from the notes of the musical input to change the musical input to the second scale.

17. The system of claim 14 wherein changing the input melody from a first tonality to a second tonality includes changing between Greek modes or changing from a Greek mode to a non-Greek Scale.

18. The system of claim 12 wherein applying the one or more functions that change the compositional nature of the musical input includes changing a melodic structure of the musical input.

19. The system of claim 18 wherein changing the melodic structure of the musical input includes changing a phrase length of the musical input.

20. The system of claim 19 wherein changing the melodic structure of the musical input includes changing an ornamentation of the musical input.

21. The system of claim 19 wherein changing the melodic structure of the musical input includes adding a retrograde to the musical input or adding an inversion to the musical input.

22. The system of claim 12 wherein applying the one or more functions that change the compositional nature of the musical input includes changing a rhythmic density or rhythmic complexity of the musical input.

23. The system of claim 22 further comprising a fader board coupled to the processor and wherein the settings of faders or switches on the fader board control the application of the one or more functions to the musical input.

24. Non-transitory instructions embedded in a computer readable medium that when executed by a computer cause the computer to carry out the method for electronic music generation comprising:

electronically applying one or more functions that change a compositional nature of a musical input in a first tonality to generate a musical output in a second tonality, wherein applying the one or more functions includes changing the harmonic density of the musical input to generate variations in a harmony of the musical output, including changing a consonance or dissonance of the harmony of the musical output; and recording data corresponding to the musical output in a recording medium.

* * * * *